US006182627B1

(12) United States Patent
Matthews

(10) Patent No.: US 6,182,627 B1
(45) Date of Patent: Feb. 6, 2001

(54) SEGMENTED CAMSHAFT ASSEMBLY FOR AN INTERNAL COMBUSTION ENGINE

(75) Inventor: William F. Matthews, Lafayette, IN (US)

(73) Assignee: Caterpillar Inc., Peoria, IL (US)

( * ) Notice: Under 35 U.S.C. 154(b), the term of this patent shall be extended for 0 days.

(21) Appl. No.: 09/325,989

(22) Filed: Jun. 4, 1999

(51) Int. Cl.[7] ..... F01L 1/047
(52) U.S. Cl. ..... 123/90.6; 123/508; 74/567
(58) Field of Search ..... 123/90.6, 508; 74/567

(56) References Cited

U.S. PATENT DOCUMENTS 4,638,683 * 1/1987 Ogawa et al. ..... 74/567
5,287,840 2/1994 Catanu et al. ..... 123/508
5,577,420 * 11/1996 Riemscheid et al. ..... 74/567
5,664,463 * 9/1997 Amborn et al. ..... 74/567
5,778,841 7/1998 Reedy et al. ..... 123/90.34
5,826,461 * 10/1998 Kaywood et al. ..... 74/567
5,979,386 * 11/1999 Swars ..... 123/90.6

* cited by examiner

*Primary Examiner*—Wellun Lo
(74) *Attorney, Agent, or Firm*—Todd T. Taylor

(57) ABSTRACT

An internal combustion engine includes a housing with a plurality of bearing supports. Each bearing support has a substantially circular interior bearing surface. A segmented camshaft assembly includes at least two camshafts axially adjacent to each other to define at least one adjacent pair of camshafts. Each camshaft is rotatably carried by the housing and includes a plurality of cam lobes. The camshaft assembly also includes at least one connector assembly, with each connector assembly connecting an adjacent pair of camshafts together. Each connector assembly has an exterior bearing surface disposed within and rotatably carried by a corresponding interior bearing surface in the housing.

15 Claims, 3 Drawing Sheets

SEGMENTED CAMSHAFT ASSEMBLY FOR AN INTERNAL COMBUSTION ENGINE

TECHNICAL FIELD

The present invention relates to internal combustion engines, and, more particularly, to a segmented camshaft assembly in an internal combustion engine.

BACKGROUND ART

An internal combustion engine typically includes a crankshaft which drives a camshaft through a gear set disposed on an end of the engine. The camshaft includes a plurality of cam lobes which drive rocker arms used to actuate valves and injectors associated with a plurality of combustion cylinders. In a large internal combustion engine, it is known to provide a segmented camshaft assembly with two camshaft segments which are axially aligned with each other and connected in an end-to-end manner using a connector assembly. The connector assembly typically is in the form of a flange on adjacent ends of the camshafts. Each flange has an axial face, with the axial faces abutting each other. A plurality of bolts are received within bolt holes in the flanges and used to bolt the flanges together.

A problem associated with a conventional segmented camshaft assembly is that the connector assembly only functions as a connector between the two camshaft segments. Thus, additional space must be provided for the connector assembly, which increases the length of the engine. Increasing the length of the engine may be undesirable, and increases manufacturing costs.

The present invention is directed to overcoming one or more of the problems as set forth above.

DISCLOSURE OF THE INVENTION

In one aspect of the invention, an internal combustion engine includes a housing with a plurality of bearing supports. Each bearing support has a substantially circular interior bearing surface. A segmented camshaft assembly includes at least two camshafts axially adjacent to each other to define at least one adjacent pair of camshafts. Each camshaft is rotatably carried by the housing and includes a plurality of cam lobes. The camshaft assembly also includes at least one connector assembly, with each connector assembly connecting an adjacent pair of camshafts together. Each connector assembly has an exterior bearing surface disposed within and rotatably carried by a corresponding interior bearing surface in the housing.

In another aspect of the invention, an internal combustion engine includes a housing with a plurality of bearing supports. Each bearing support has an interior bearing surface. A segmented camshaft assembly includes at least two camshafts axially adjacent to each other to define at least one adjacent pair of camshafts. Each camshaft is rotatably carried by the housing and includes a plurality of cam lobes. The camshaft assembly also includes at least one connector assembly. Each connector assembly connects an adjacent pair of camshafts together. Each connector assembly includes a first flange on one of the adjacent pair of camshafts and a second flange on an other of the adjacent pair of camshafts. The first flange includes an axially extending recess and the second flange is disposed in the recess. The first flange has an exterior bearing surface disposed within and rotatably carried by a corresponding interior bearing surface in the housing.

BEST MODE FOR CARRYING OUT THE INVENTION

Figure 1:
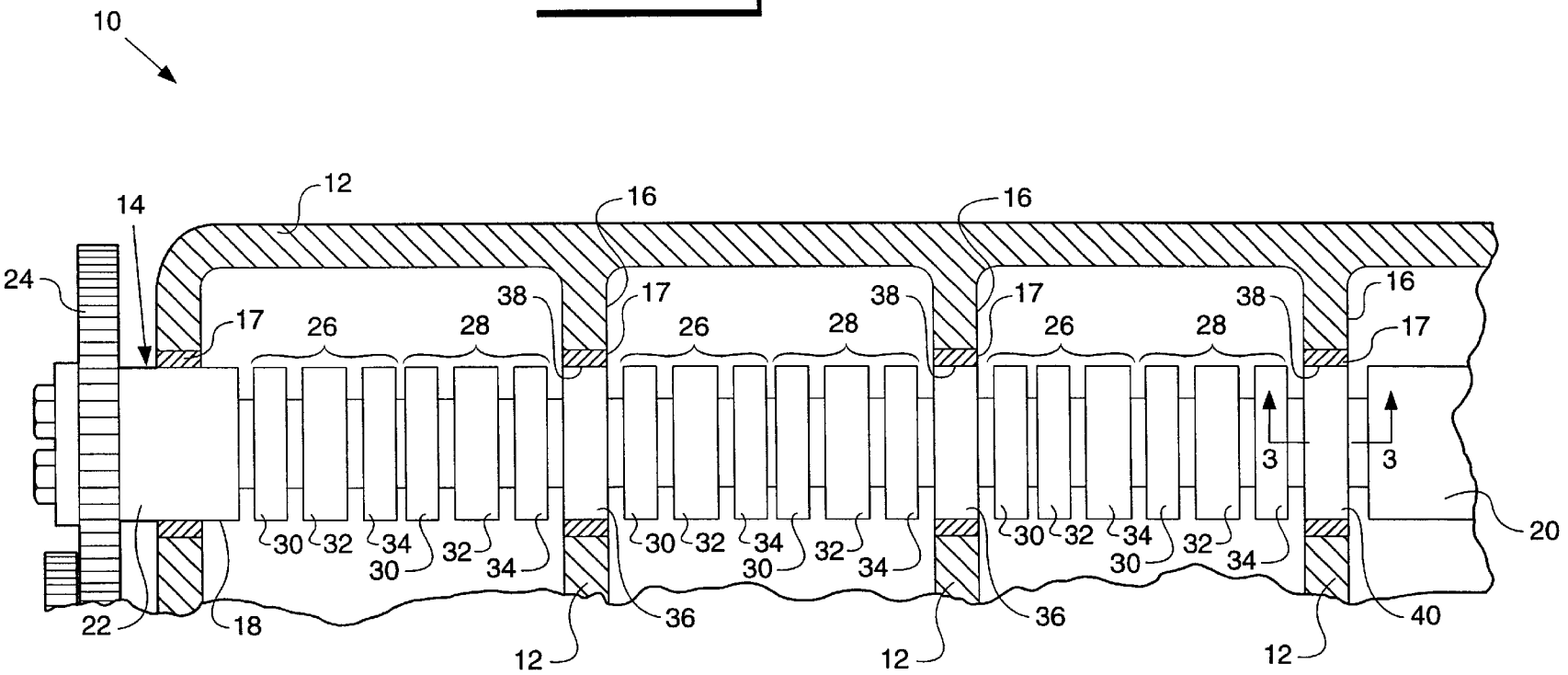
FIG. 1 is a fragmentary top view of a portion of an internal combustion engine, including an embodiment of a segmented camshaft assembly of the present invention.
Figure 2:
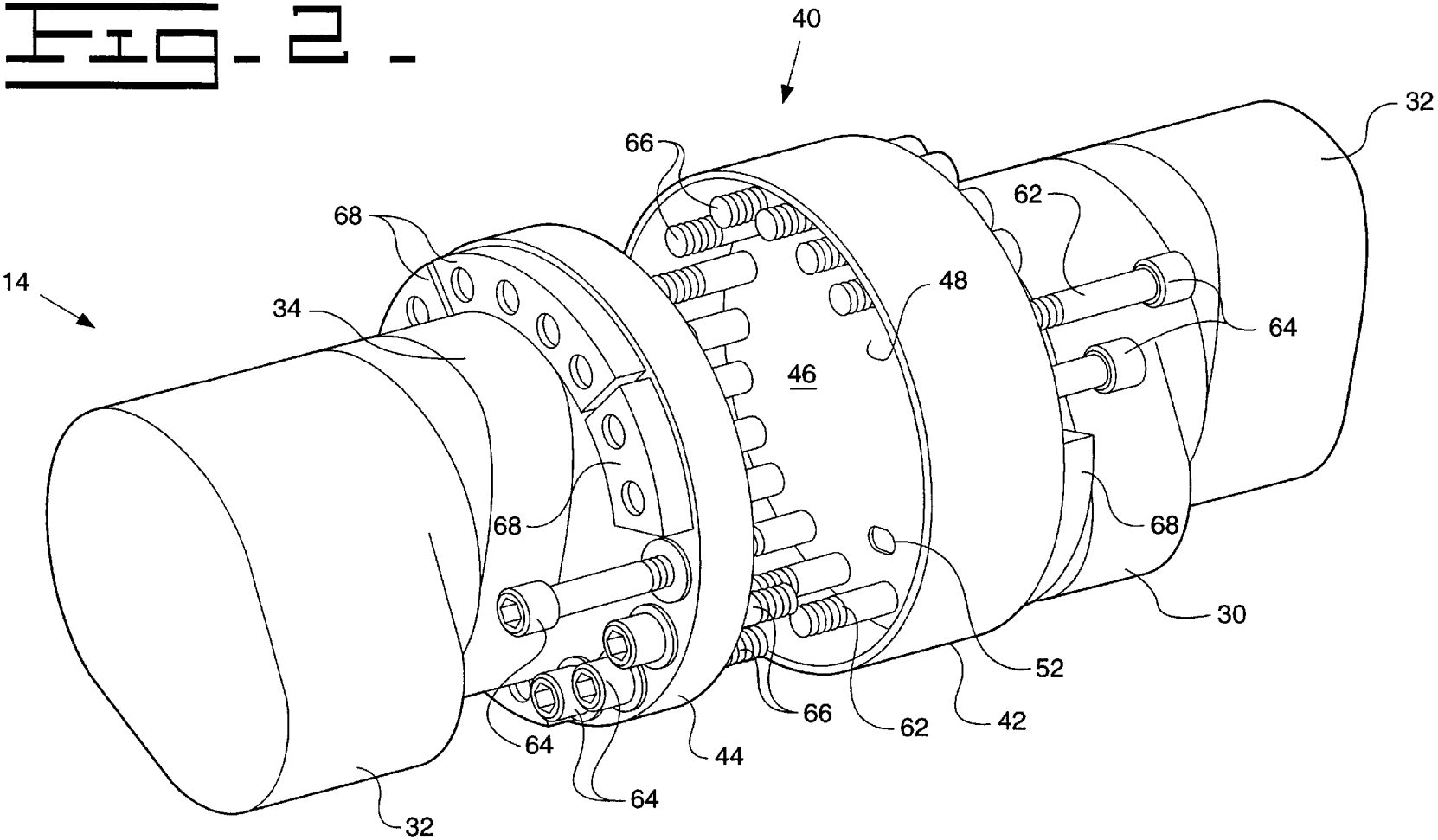
FIG. 2 is a fragmentary, perspective view of the connector assembly in FIG. 1 used to connect axially adjacent camshafts together.
Figure 3:
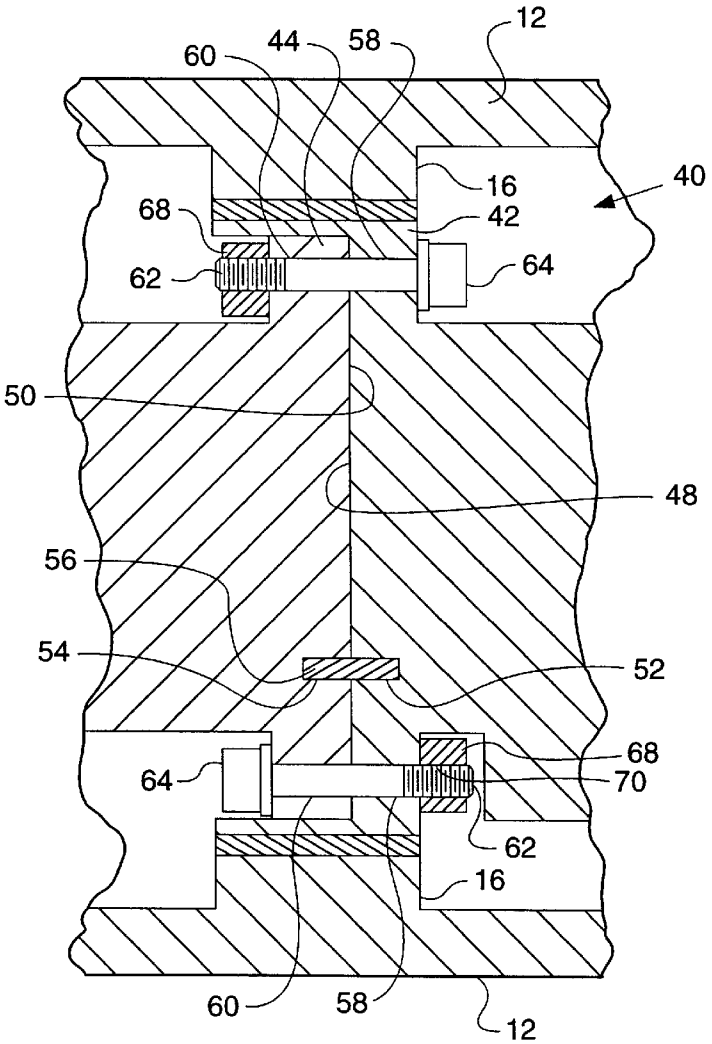
FIG. 3 is a side, sectional view of the connector assembly taken along line 3—3 in FIG. 1.

Referring now to the drawings, and particularly to FIG. 1, there is shown a portion of an internal combustion engine 10 which includes a housing 12 and a segmented camshaft assembly 14. Internal combustion engine 10 also includes other components, such as a crankshaft, a plurality of cylinders and a plurality of pistons reciprocally disposed within the cylinders (not shown).

Housing 12 typically is of cast construction, and includes a plurality of bearing supports 16 that support respective optional steel backed aluminum full round bearings 17. Each bearing support 16 includes a substantially circular interior bearing surface 38 for carrying camshaft assembly 14.

Segmented camshaft assembly 14 is rotatably carried by housing 12, as indicated above. Segmented camshaft assembly 14 includes two camshafts 18 and 20 which are disposed axially adjacent to each other and define at least one pair of axially adjacent camshafts. Depending upon the length and/or configuration of internal combustion engine 10, more than two camshafts may be provided. Camshaft 18 includes an end 22 which is attached with and carries a gear 24. Gear 24 emmeshes with other suitable gears to rotatably drive camshaft assembly 14. For example, gear 24 may be directly or indirectly emmeshed with a gear on the end of a crankshaft (not shown).

For ease of illustration, only camshaft 18 will be described in detail hereinafter. However, the configuration of camshaft 20 is similar to that of camshaft 18, except for differences which will be noted. Camshaft 18 includes a plurality of cam sets 26 and 28, with each cam set 26 and 28 being associated with a respective combustion cylinder. Each cam set 26 and 28 includes three cam lobes 30, 32 and 34. Each cam lobe 30 is associated with a combustion air intake valve (not shown); each cam lobe 34 is associated with an exhaust valve (not shown); and each cam lobe 32 is associated with a fuel injector (not shown). If housing 12 includes a "V" configuration with a first bank of combustion cylinders on one side and another bank of cylinders on another side, each cam set 26 may be associated with a corresponding cylinder in one bank of cylinders; and each cam set 28 may be associated with a cylinder in the other bank of cylinders.

Cam sets 26 and 28 are sequentially arranged axially adjacent to each other along the length of camshaft 18. Between each axially adjacent pair of cam sets 26 and 28, camshaft 18 also includes a cylindrical bearing 36 which is disposed within and rotatably carried by a corresponding cylindrical interior bearing surface 38 of a bearing 17. Camshaft 18 is thus intermittently rotatably supported along the length thereof by housing 12.

With conventional segmented camshaft assemblies, camshafts 18 and 20 may be connected together using a bolted flange connection. Space must be allowed in the configuration of housing 12 for the bolted flange connection between camshafts 18 and 20. The space for the flange connection is unused, except for the flange connection itself, and increases the length of combustion engine 10, which may be undesirable.

According to an aspect of the present invention, camshafts 18 and 20 are connected together using a connector assembly 40 which is disposed radially within a cylindrical bearing surface 38 of a bearing 17 carried by housing 12. Thus, connector assembly 40 provides the dual functionality of connecting camshafts 18 and 20 together, while at the same time defining a bearing surface which is rotatably carried within a bearing 17 of housing 12. By combining the connector and bearing functions together, the overall length of internal combustion engine 10 is reduced.

Connector assembly 40 generally includes a first flange 42 on camshaft 20 and a second flange 44 on camshaft 18. First flange 42 includes an axially extending recess 46 defining an end face 48 against which second flange 44 abuts. Second flange 44 includes an outside diameter which is received within recess 46 and used to axially align camshaft 18 and camshaft 20, and includes an end face 50 which abuts against end face 48. Each of end faces 48 and 50 include an axially extending hole 52 and 54, respectively. An alignment dowel 56 is disposed within holes 52 and 54, and provides keyed rotational alignment between camshafts 18 and 20.

First flange 42 and second flange 44 each include a plurality of bolt holes 58 and 60, respectively. Bolt holes 58 and 60 are substantially axially aligned with each other when second flange 44 is received within recess 46 of first flange 42, and alignment dowel 56 is positioned within each of keyed alignment holes 52 and 54. A plurality of bolts 62 are disposed within bolt holes 58 and 60 and connect first flange 42 together with second flange 44.

Each of bolts 62 includes a head 64 and an opposite threaded end 66. Bolts 62 may be placed within bolt holes 58 and 60 from one or both directions, depending upon the orientation of a cam lobe 34 or 30 adjacent to first flange 42 and second flange 44. That is, the lobe portion of a cam lobe may not allow a bolt 62 to be inserted from a particular axial direction. Thus, bolt 62 may be placed within bolt holes 56 and 58 in either selected axial direction.

To allow bolt 62 to be placed within bolt holes 58 and 60 from either direction, a plurality of keeper blocks 68 may be selectively positioned against first flange 42 or second flange 44, depending upon the axial directional orientation of bolts 62. Each keeper block 68 includes at least one threaded bolt hole 70 therein. Each keeper block 68 has an arcuate shape which corresponds to the pattern of bolt holes 58 and 60 and first flange 42 and second flange 44, such that the threaded bolt holes 70 in keeper block 68 align with bolt holes 58 and 60. In the embodiment shown, each keeper block 68 includes two threaded bolt holes 70 therein. Some of keeper blocks 68 are disposed adjacent to first flange 42, while others of keeper blocks 68 are disposed adjacent to second flange 44.

INDUSTRIAL APPLICABILITY

To assemble segmented camshaft assembly 14, each camshaft 18 and 20 is slid into housing 12. Dowel 56 is placed within one of holes 52 and 54, and second flange 44 is positioned within first flange 42. First flange 42 and second flange 44 are preferably assembled with each other at a location between two bearing supports 16 for ease of assembly. Bolts 62 are placed through each pair of corresponding bolt holes 58 and 60 and threaded into an associated keeper block 68. Camshafts 18 and 20 are then slid in an assembled state in an axial direction such that the assembled connector assembly 40 is positioned within a cylindrical bearing surface 38 of a bearing 17. The outside cylindrical surface of first flange 42 is rotatably carried by and within an associated bearing 36.

In the method of assembly as described above, camshafts 18 and 20 are first slid into housing 12 and then assembled together using connector assembly 40. It may also be possible to first assemble camshafts 18 and 20 together using connector assembly 40, and thereafter slide camshafts 18 and 20 into housing 12 in an assembled state.

During use, connector assembly 40 of camshaft assembly 14 provides the dual functionality of connecting camshafts 18 and 20 together, as well as defining a bearing surface 36 disposed within a bearing 17. Connector assembly 40 thereby allows camshafts 18 and 20 to be connected together in a manner which reduces the overall length of internal combustion engine 10. Additionally, the keyed alignment between camshafts 18 and 20 assures proper rotational alignment therebetween. Moreover, keeper blocks 68 allow bolts 62 to be inserted from either axial direction into bolt holes 58 and 60, and are configured to be engaged with either first flange 42 or second flange 44.

Other aspects, objects and advantages of this invention can be obtained from a study of the drawings, the disclosure and the appended claims.

What is claimed is:

1. An internal combustion engine, comprising:

a housing including a plurality of bearing supports, each said bearing support having a substantially cylindrical interior bearing surface; and a segmented camshaft assembly including at least two camshafts axially adjacent to each other to define at least one adjacent pair of said camshafts, each said camshaft being rotatably carried by said housing and including a plurality of cam lobes, said camshaft assembly including at least one connector assembly, each said connector assembly connecting an adjacent said pair of camshafts together, each said connector assembly having an exterior bearing surface disposed within and rotatably carried by a corresponding said interior bearing surface in said housing, each said connector assembly including a first flange on one of said adjacent pair of camshafts and a second flange on an other of said adjacent pair of camshafts, said first flange including an axially extending recess and said second flange being disposed in said recess.

2. The internal combustion engine of claim 1, wherein said first flange includes said exterior bearing surface.

3. The internal combustion engine of claim 1, wherein each said first flange and said second flange include a plurality of bolt holes, said bolt holes in said first flange substantially axially aligning with said bolt holes in aid second flange, and further comprising a plurality of bolts disposed in said bolt holes and connecting said first flange and said second flange together.

4. The internal combustion engine of claim 3, wherein each of said bolts includes a head and an opposite threaded end, each said bolt head disposed against a corresponding one of said flanges and each said threaded end extending from a corresponding other of said flanges, and further comprising a plurality of keeper blocks, each said keeper block associated with at least one of said bolts and disposed against said corresponding other flange, each said keeper block including at least one threaded bolt hole engaged with said threaded end of said at least one associated bolt.

5. The internal combustion engine of claim 4, wherein at least one of said keeper blocks is disposed against said first flange and at least one other of said keeper blocks is disposed against said second flange.

6. The internal combustion engine of claim 1, wherein one of said first flange and said second flange includes an end face with an axially extending hole, and further including an alignment dowel extending from an other of said first flange and said second flange, said dowel received within said hole, said dowel and said hole providing keyed rotational alignment between said adjacent pair of camshafts.

7. The internal combustion engine of claim 6, wherein said other of said first flange and said second flange includes an end face with an axially extending hole, and wherein said dowel is disposed in each of said holes.

8. An internal combustion engine, comprising:

a housing including a plurality of bearing supports, each said bearing support having an interior bearing surface; and a segmented camshaft assembly including at least two camshafts axially adjacent to each other to define at least one adjacent pair of said camshafts, each said camshaft being rotatably carried by said housing and including a plurality of cam lobes, said camshaft assembly including at least one connector assembly, each said connector assembly connecting an adjacent said pair of camshafts together, each said connector assembly including a first flange on one of said adjacent pair of camshafts and a second flange on an other of said adjacent pair of camshafts, said first flange including an axially extending recess and said second flange disposed in said recess, said first flange having an exterior bearing surface disposed within and rotatably carried by a corresponding said interior bearing surface in said housing.

9. The internal combustion engine of claim 8, wherein each of said first flange and said second flange include a plurality of bolt holes, said bolt holes in said first flange substantially axially aligning with said bolt holes in said second flange, and further comprising a plurality of bolts disposed in said bolt holes and connecting said first flange and said second flange together.

10. The internal combustion engine of claim 9, wherein each of said bolts includes a head and an opposite threaded end, each said bolt head disposed against a corresponding one of said flanges and each said threaded end extending from a corresponding other of said flanges, and further comprising a plurality of keeper blocks, each said keeper block associated with at least one of said bolts and disposed against said corresponding other flange, each said keeper block including at least one threaded bolt hole engaged with said threaded end of said at least one associated bolt.

11. The internal combustion engine of claim 10, wherein at least one of said keeper blocks is disposed against said first flange and at least one other of said keeper blocks is disposed against said second flange.

12. The internal combustion engine of claim 8, wherein one of said first flange and said second flange includes an end face with an axially extending hole, and further including an alignment dowel extending from an other of said first flange and said second flange, said dowel received within said hole, said dowel and said hole providing keyed rotational alignment between said adjacent pair of camshafts.

13. The internal combustion engine of claim 12, wherein said other of said first flange and said second flange includes an end face with an axially extending hole, and wherein said dowel is disposed in each of said holes.

14. The internal combustion engine of claim 8, wherein said bearing support includes a steel backed aluminum bearing defining said interior bearing surface.

15. A segmented camshaft assembly for use in an internal combustion engine, the internal combustion engine including a housing having a bearing support with an interior bearing surface, said segmented camshaft assembly comprising:

a first camshaft segment including a plurality of cam lobes, said first camshaft segment including a first flange with an axially extending recess, said first flange having an exterior bearing surface configured to be disposed within and rotatably carried by the interior bearing surface in the housing; and a second camshaft segment including a plurality of cam lobes, said second camshaft segment including a second flange coupled with said first flange and disposed within said recess.

* * * * *